US012180824B2

(12) United States Patent
Kamgang et al.

(10) Patent No.: US 12,180,824 B2
(45) Date of Patent: Dec. 31, 2024

(54) ANISOTROPIC CASING SOLIDS AND FLUIDS IDENTIFICATION SYSTEM AND METHOD USING SHEAR AND FLEXURAL ACOUSTIC WAVES

(71) Applicant: Baker Hughes Oilfield Operations LLC, Houston, TX (US)

(72) Inventors: Sebastien Kamgang, Houston, TX (US); Joseph Olaiya, Houston, TX (US); Emma Smith, Houston, TX (US); Douglas Patterson, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/750,912

(22) Filed: May 23, 2022

(65) Prior Publication Data

US 2022/0381137 A1 Dec. 1, 2022

Related U.S. Application Data

(60) Provisional application No. 63/192,956, filed on May 25, 2021.

(51) Int. Cl.
*E21B 47/005* (2012.01)
*E21B 47/085* (2012.01)

(52) U.S. Cl.
CPC ..... *E21B 47/005* (2020.05); *E21B 47/085* (2020.05)

(58) Field of Classification Search
CPC ..... E21B 47/005; E21B 47/085
USPC ..... 367/35; 181/105
See application file for complete search history.

(56) References Cited

U.S. PATENT DOCUMENTS

| | | | | |
|---|---|---|---|---|
| 10,247,707 | B1 * | 4/2019 | Pollock | G01N 33/383 |
| 11,073,630 | B2 * | 7/2021 | Jones | G01V 1/48 |
| 2007/0206439 | A1 * | 9/2007 | Barolak | E21B 47/005 367/35 |
| 2008/0112262 | A1 * | 5/2008 | Tang | G01B 17/02 367/35 |
| 2014/0177389 | A1 * | 6/2014 | Bolshakov | G01V 1/50 367/35 |
| 2015/0198732 | A1 | 7/2015 | Zeroug | |
| 2019/0145241 | A1 | 5/2019 | Yao | |
| 2020/0300077 | A1 | 9/2020 | Matuszyk | |

OTHER PUBLICATIONS

International Search Report and Written Opinion mailed Aug. 24, 2022 in corresponding PCT Application No. PCT/US22/30663.

* cited by examiner

*Primary Examiner* — Isam A Alsomiri
*Assistant Examiner* — Abdallah Abulaban
(74) *Attorney, Agent, or Firm* — Hogan Lovells US LLP

(57) ABSTRACT

A system for evaluation of a sheathing behind a casing of a wellbore. One or more wave generators provide at least asymmetric lamb (AL) waves through a casing having an anisotropic property in a first mode of the system, and provide at least shear horizontal acoustic (SHA) waves through the casing in a second mode that is concurrent with the first mode. A receiver receives indications associated with the SHA waves and the AL waves. At least one processor determines a quality of the sheathing behind the casing based in part on the indications associated with the SHA waves and the AL waves.

20 Claims, 4 Drawing Sheets

ANISOTROPIC CASING SOLIDS AND FLUIDS IDENTIFICATION SYSTEM AND METHOD USING SHEAR AND FLEXURAL ACOUSTIC WAVES

CROSS-REFERENCES TO RELATED APPLICATIONS

This application is related to and claims the benefit of priority from U.S. Provisional Application No. 63/192,956, titled ANISOTROPIC CASING SOLIDS AND FLUIDS IDENTIFICATION SYSTEM AND METHOD USING SHEAR AND FLEXURAL ACOUSTIC WAVES, filed on May 25, 2021, the entire disclosure of which is incorporated by reference herein for all intents and purposes.

BACKGROUND

1. Field of Invention

This invention relates in general to equipment used in the natural gas industry, and in particular, to identification or differentiation of annular solids and fluids associated with an anisotropic casing using a combination of shear and flexural acoustic waves.

2. Description of the Prior Art

A drilling well is a structure formed in subterranean or underwater geologic structures, or layers. Such subterranean or underwater geologic structures or layers incorporate pressure that may be further enhanced by supplementing formation fluids (such as liquids, gasses or a combination) into a drill site or a well site (such as a wellbore). Wireline logging tools may be used with capability to evaluate a cement sheath or lack thereof, in an annular space behind a casing, when such a casing is homogeneous in nature. Methodologies employed for evaluating annular solids and fluids, behind a casing, can assume that a casing has isotropic properties. Such an assumption fails for nonconformal casings.

SUMMARY

In at least one embodiment, a system for evaluation of a sheathing behind a casing of a wellbore is disclosed. One or more wave generators provide at least asymmetric lamb (AL) waves through a casing having an anisotropic property in a first mode of the system, and provide at least shear horizontal acoustic (SHA) waves through the casing in a second mode that is concurrent with the first mode. A receiver receives indications associated with the SHA waves and the AL waves. At least one processor determines a quality of the sheathing behind the casing based in part on the indications associated with the SHA waves and the AL waves.

In at least one embodiment, a method for evaluation of a sheathing behind a casing of a wellbore is disclosed. A step in the method is to provide, using one or more wave generators, at least asymmetric lamb (AL) waves through a casing having an anisotropic property in a first mode of the system, and at least shear horizontal acoustic (SHA) waves through the casing in a second mode that is concurrent with the first mode. A step in the method is to receive, using a receiver, indications associated with the SHA waves and the AL waves. A further step in the method is to determine, using at least one processor, a quality of the sheathing behind the casing based in part on the indications associated with the SHA waves and the AL waves.

BRIEF DESCRIPTION OF THE DRAWINGS

Various embodiments in accordance with the present disclosure will be described with reference to the drawings, in which.

DETAILED DESCRIPTION

Figure 1:
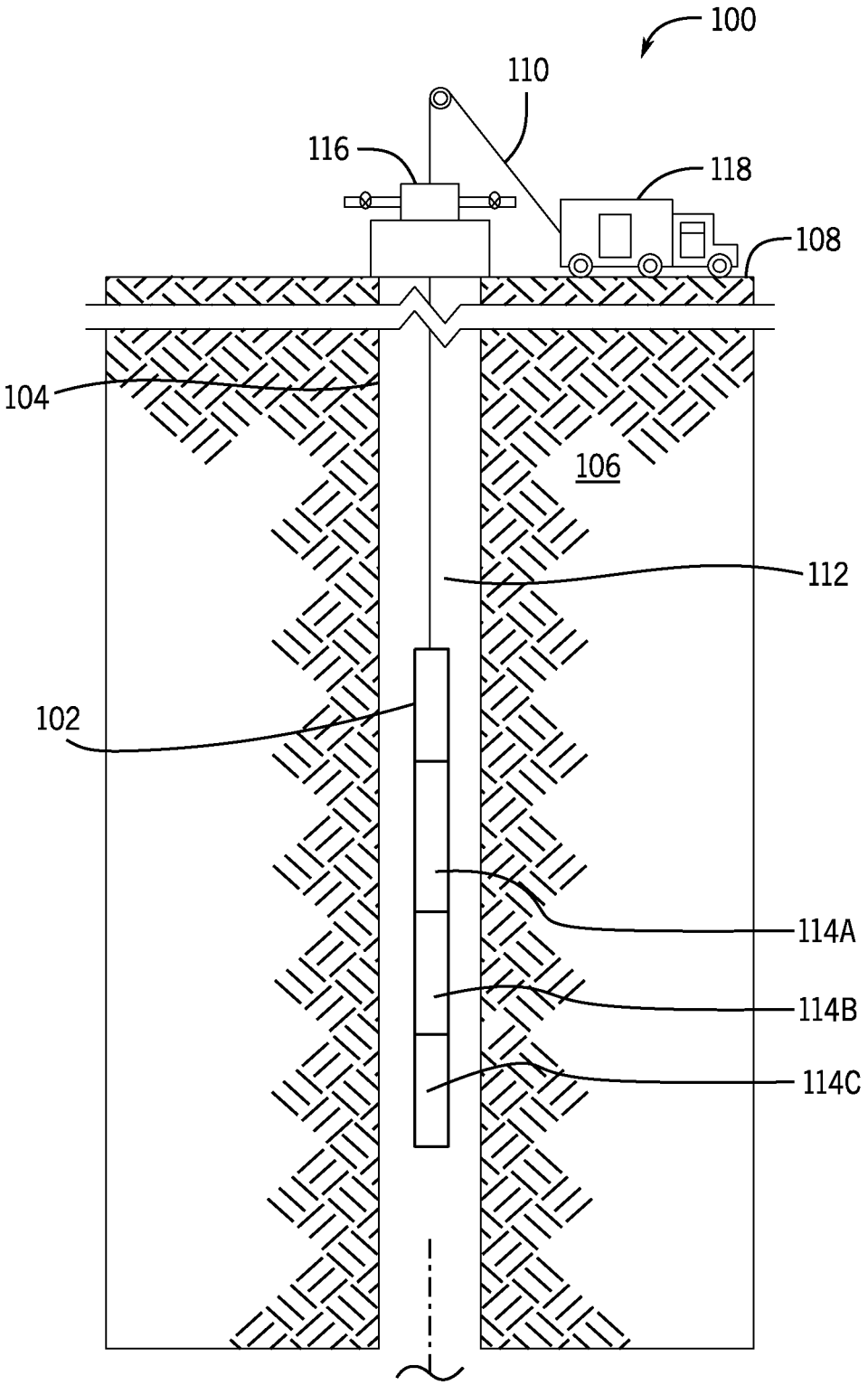
FIG. 1 illustrates an example environment subject to improvements of at least one embodiment herein.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various other functions can be implemented within the various embodiments as well as discussed and suggested elsewhere herein. In at least an aspect, the present disclosure is to a system and a method for identification or differentiation of annular solids and fluids associated with an anisotropic casing using a combination of shear and flexural acoustic waves.

In at least one embodiment, a system and method herein can address deficiencies previous raised and noted throughout herein by including a downhole tool having a wireline cement evaluation tool for evaluation of sheathing behind a casing in a borehole or downhole application. A wireline cement evaluation tool may include wave generators to provide a combination of an asymmetric lamb (AL) mode and a shear horizontal acoustic (SHA) mode for a wireline cement evaluation tool. Such combination of modes, also referred to as a first mode and a second mode, represents an output of acoustic waves that is a combination of an AL wave and an SHA wave sent through a casing and into a cementitious material behind a casing.

An AL mode enables an AL wave that may be a coupled output of compressional and shear waves. In such a coupled output, particle displacement is enabled to be normal to a casing surface, while wave propagation of an AL wave is perpendicular to such a particle displacement. Such a system herein is able to then identify or differentiate between presence of fluids and solids behind anisotropic casings. An anisotropic casing can have, for instance, a high chromium content from 13% to 28%.

In such a system, an SHA mode is such that a direction of a particle displacement from an AL mode may be rotated 90° relative to a direction caused by the AL mode. In effect, a particle displaced by a SHA mode is then parallel to a casing surface. Such transition of direction of displaced particles, resulting from both an AL and an SHA modes enables features herein to detect both solid and fluid aspects of cementitious materials behind a casing, distinct from limitations previously described. In such a system, a wireline cement evaluation tool, uses reflected waves based on shear and flexural responses, which are characterized to obtain baseline values. Such baseline values are with reference to free pipe with water or air behind a casing. Such baseline values may be then used to interpret aspects of cementitious material behind a casing. This procedure can be used, for example, in evaluation of cementitious sheathing behind a high chromium casing that has in excess of 13% chromium or can be used with coated casings.

In at least one embodiment, FIG. 1 illustrates an example environment 100 subject to improvements described herein. A system, such as for identification or differentiation of annular solids and fluids associated with an anisotropic casing using a combination of shear and flexural acoustic waves, may include one or more downhole and/or platform-based tools 102. In at least one embodiment, a platform-based tool may be above terrain surface 108 (of terrain 106) or above water surface. In at least one embodiment, such a downhole and/or platform-based tool 102 may be part of a string 112 of tools, which may include other components utilized for wellbore operations.

In at least one embodiment, a string 112 may include other tools 114A-114C than components or an entire fast in-field chromatography system. In at least one embodiment, such tools may be part of sensors, measurement devices, communication devices, and the like. In at least one embodiment, a string 112 may include one or more tools to enable at least one of a logging operation (such as mud-gas logging), for perforating operation, or for well intervention. In at least one embodiment, nuclear logging tools, fluid sampling tools, and core sampling devices may be also used in a string 112.

In at least one embodiment, perforating operations may include ballistic devices being lowered into a wellbore 104 to perforate casing or the formation. In at least one embodiment, well interventions may include operations relating to analysis of one or more features of a wellbore 104, followed by performing one or more tasks in response to at least one feature. In at least one embodiment, one or more features may include data acquisition, cutting, and cleaning. As such, in at least one embodiment, a string 112 may refer to a combination of one or more tools lowered into a wellbore 104. In at least one embodiment, passive devices may also be included, such as centralizers or stabilizers. In at least one embodiment, tractors may be provided to facilitate movement of a string 112.

In at least one embodiment, power and/or data conducting tools may be used to send and receive signals and/or electrical power. In at least one embodiment, sensors may be incorporated into various components of a string 112 and may be enabled to communicate with a surface (platform) or with other string components. In at least one embodiment, such communication may be via a cable 110, via mud pulse telemetry, via wireless communications, and via wired drill pipe, in a non-limiting manner. In at least one embodiment, it should be appreciated that while embodiments may include a wireline system, a rigid drill pipe, coiled tubing, or any other downhole exploration and production methods may be utilized with at least one embodiment herein.

In at least one embodiment, an environment 100 includes a wellhead assembly 116 shown at an opening of a wellbore 104 to provide pressure control of a wellbore and to allow for passage of equipment into a wellbore 104. In at least one embodiment, such equipment may include a cable 110 and a string 112 of tools. In at least one embodiment, a cable 110 is or may include a wireline that is spooled from a service truck 118. In at least one embodiment, a cable 110 may extend to an end of a string 112. In at least one embodiment, during operation, a cable 110 may be provided with some slack as a string 112 is lowered into a wellbore 104 to a predetermined depth.

In at least one embodiment, fluid may be delivered into a wellbore 104 to drive or assist in movement of a string 112. In at least one embodiment, this may be a case where gravity may not be sufficient to assist, such as in a deviated wellbore. In at least one embodiment, a fluid pumping system may be provided at a surface 108 to pump fluid from a source into a wellbore 104 via a supply line or conduit. In at least one embodiment, control of a rate of travel of a downhole assembly and/or control of tension on a wireline 110 may be provided by a winch on a surface 108. In at least one embodiment, such a winch system may be part of a service tuck 118. In at least one embodiment, a combination of fluid flow rate and tension on a wireline 110 can contribute to a travel rate or rate of penetration of a string 112 into a wellbore 104.

In at least one embodiment, a provided cable 110 may be an armored cable that includes conductors for supplying electrical energy (power) to downhole devices and communication links for providing two-way communication between a downhole tool and surface devices. In at least one embodiment, tools such as tractors, may be disposed along a string 112 to facilitate movement of such a string 112 into a wellbore 104. In at least one embodiment, a string 112 may be retrieved from a wellbore 104 by reeling a provided cable 110 upwards using such a service truck 118. In at least one embodiment, logging operations may be performed as a string 112 is brought to a surface 108.

In at least one embodiment, a system of a downhole tool 102 can include a wireline cement evaluation tool for identification or differentiation of annular solids and fluids associated with an anisotropic casing using a combination of shear and flexural acoustic waves. In at least one embodiment, wireline logging tools are able to evaluate a cement or other sheathing (from materials associated there with) or lack thereof (from lack of such materials). Such sheathing is in an annular space that is behind a casing. When a casing is homogeneous, an identification or differentiation, followed by analysis of material behind a casing may be accomplished by shear or by longitudinal waves.

Methodologies employed for evaluating annular solids and fluids that may form materials of a sheathing and that are located behind a casing may assume a casing to have isotropic properties and to be homogenous. Such methodologies may work for such casings but may encounter problems when casings are nonconforming. In at least one embodiment, a nonconforming casing is a casing having anisotropic properties. In at least one embodiment, a nonconforming casing may be represented by a casing having a high content of chromium that is from 13% to 28% of a casing material. An anisotropic property of a casing can be due to its metallurgical makeup, manufacturing methodology, physical construction, or various combinations of such features.

A methodology used to determine sheathing features herein can verify a condition of a cementitious material forming such a sheathing and that is located behind a casing. In at least one embodiment, a downhole tool, such as in FIG. 1, may be used. Conveyance of a downhole tool may be made through wireline that may include acoustic tools, such as a wireline cement evaluation logging tool in any of tools 114A-C. An improvement herein enables such a tool that makes downhole measurements of acoustic waves to use particles that may be transitioned to flow from perpendicular to parallel within a direction of a casing.

Figure 2:
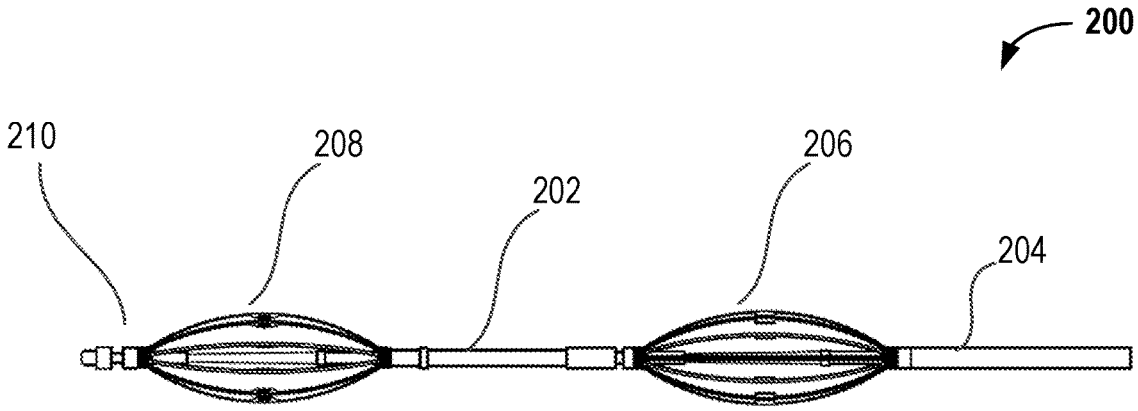
FIG. 2 illustrates a system of a downhole tool that can include a wireline cement evaluation tool within the system for identification or differentiation of annular solids and fluids associated with an anisotropic casing using a combination of shear and flexural acoustic waves, in at least one embodiment herein.

FIG. 2 illustrates a system of a downhole tool 200 that can include a wireline cement evaluation tool within the system for identification or differentiation of annular solids and fluids associated with an anisotropic casing using a combination of shear and flexural acoustic waves. FIG. 2 may be taken as an illustration of a test or a maintenance tool 200 subject to improvements disclosed herein, in accordance with various embodiments. A tool 200 can include a downhole instrument 202 with compartments for a temperature sensor 204, a spinner array 206, a wireline cement evaluation tool 208, and resistance array 210. At least some of these components may be used to collectively provide capability to evaluate a sheathing behind a casing of a wellbore detect from a downhole application.

A wireline cement evaluation tool 208 may be coupled to an above-ground system component, such as at least one processor executing instructions from a memory to perform multiple determinations from indications associated with applied waves, for instance. In at least one embodiment, such indications may be from a reflected wave associated with applied waves. A wireline cement evaluation tool 208 may use or apply a combination of an asymmetric lamb (AL) wave in a first mode, together or concurrently with a shear horizontal acoustic (SHA) wave in a second mode, from a downhole tool 200 outwards to a casing and into a cementitious material.

Figure 3:
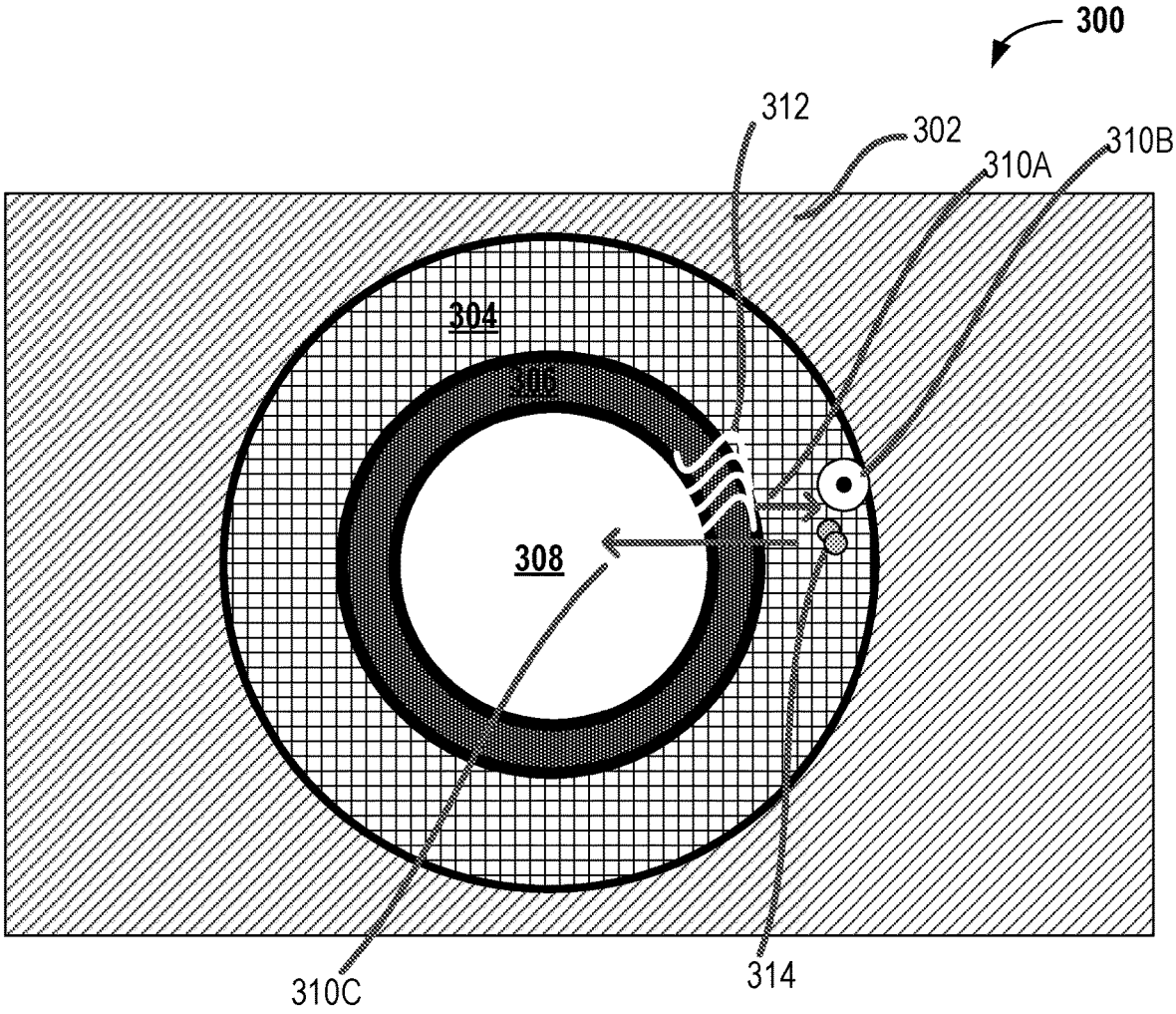
FIG. 3 illustrates borehole aspects supporting a downhole tool that can include a wireline cement evaluation tool within a system for identification or differentiation of annular solids and fluids associated with an anisotropic casing using a combination of shear and flexural acoustic waves, in at least one embodiment herein.
Figure 4:
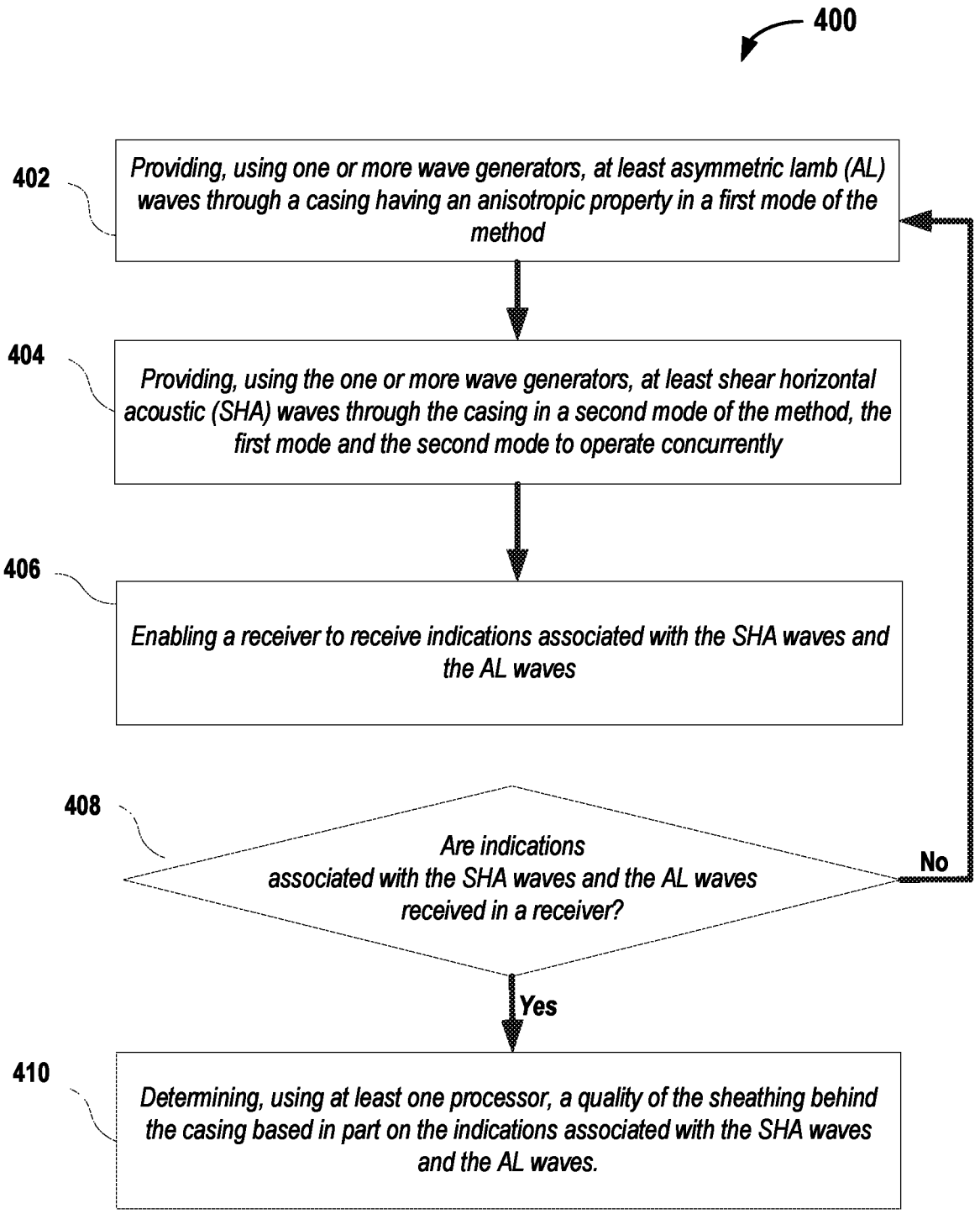
FIG. 4 illustrates a method for a system of a downhole tool that can include a wireline cement evaluation tool within the system for identification or differentiation of annular solids and fluids associated with an anisotropic casing using a combination of shear and flexural acoustic waves, in at least one embodiment herein.

FIG. 3 illustrates borehole aspects 300 supporting a downhole tool that can include a wireline cement evaluation tool within a system for identification or differentiation of annular solids and fluids associated with an anisotropic casing using a combination of shear and flexural acoustic waves. A wireline cement evaluation tool 208 is able to apply an SHA wave together with an AL wave from within a borehole 308 through casing 306 and into a cementitious material or space 304 surrounding a casing 306. In at least one embodiment, terrain 302 is bored to provide a borehole 308 that is then supported by a casing 306 and by applied cementitious material 304.

FIG. 3 also illustrates that a wireline cement evaluation tool 208 is able to provide acoustic waves that include coupled compressional and shear waves, in a first mode (representing an asymmetrical lamb mode). In such a first mode, a particle displacement of a sheathing is in a direction that is normal to a casing (such as a casing's outside surface). In such a first mode, an AL wave propagation is perpendicular to the particle displacement. In a second mode (representing a shear horizontal acoustic mode) a particle displacement from a first mode may be caused to be rotated 90°. In at least one embodiment, different particles are caused in each mode, some that are in a direction normal to a casing surface and others that are in a direction parallel to a casing surface. In at least one embodiment, such transition of directions of displaced particles, resulting from two concurrent modes of waves provided enables a receiver to receive indications associated with the SHA waves and the AL waves and, subsequently, enables at least one processor to determine a quality of the sheathing behind the casing based in part on the indications associated with the SHA waves and the AL waves.

In at least one embodiment, it is possible to differentiate between presence of fluids and solids (forming part of a cementitious or other material) that is behind an anisotropic casing. Such an anisotropic casing may be a casing having a high chromium content that is between 13% to 28% of total material content of such a casing. A wireline cement evaluation tool based on shear and flexural responses (referred to as reflected waves) are able to provide indications that are associated with applied AL and SHA waves. Such indications may be characterized to obtain baseline values for free pipe with water or air behind a casing. These baseline values may be then used to interpret cementitious solids and fluids behind a casing.

A receiver of a wireline cement evaluation tool 208, that is within a casing 308, may be enabled to receive a reflected wave 310C. Such a reflected wave 310C may be associated with particles released by at least a material of a sheathing 304. A reflected wave 310C may represent indications associated with an applied combination of SHA waves and the AL waves, generally represented by at least reference number 312 show AL waves having a perpendicular direction to such a particle's 314 displacement direction 310A. A particle's 314 displacement direction 310A may be changed to a parallel direction 310B extending along a casing (into or out of the plan view of FIG. 3). A reflected wave 310C may be caused by an interaction of one or more of the SHA waves or the AL waves 312 with the particles 314.

Such indications in a reflected wave 310C that are also associated with the SHA waves and the AL waves may be further associated with different components therein to indicate presence of fluids and solids behind the casing 306. In at least one embodiment, the different components may refer to one or more attenuations in frequency or other aspects of the SHA and the AL waves. A reflected wave is a sound or acoustic signal that may be received by a detector or a receiver. A reflected wave may be transformed into an electrical signal. At least one processor can then determine an intensity of a reflected wave in its transformed form. Other components of such a reflected wave may be analyzed in comparison with the combination of the AL and SHA waves applied. For example, a travel time may be taken to determine a distance that a signal travelled before being reflected back. Features, such as, a location, an orientation, a number of particles, or a size of one or more particles may be determined from such indications in a reflected wave.

A quality of a sheathing can also include information of a bonding strength from the indications associated with the SHA waves and the AL waves. For example, indications of many particles may indicate a poor bonding strength. A bonding strength may be indicative of a strength of a chemical bond or a mechanical or frictional bond.

A quality of the sheathing may include a shear modulus and a compressional modulus. Such moduli may be determined from the indications associated with the SHA waves and the AL waves. In an example, a shear modulus and a compressional modulus may be associated with a material of the sheathing and how such material is bonded with the casing.

A first mode of a system herein includes coupled compressional waves and shear waves as part of the AL waves. The AL waves enable a particle displacement that is in a direction 310A that is normal to a surface of the casing 306. The AL wave has a wave propagation 312 that is perpendicular to a direction 310C of the particle's 314 displacement.

A first mode of the system enables a particle displacement that is in a first direction 310A that is normal to a surface of the casing 306. The particle's 314 displacement may be then caused to rotate through a 90° angle from the first direction 310A based in part on the first mode being concurrently active with the second mode. The 90° angle is to cause the particle displacement to be in a second direction 310B that is parallel to the surface of the casing 306.

A first mode of the system causes a first direction 310A for particles 314 from the sheathing 304. A second mode of the system cause a transition of the first direction 310A to a second direction 310B (into or out of the plan view of FIG. 3) by at least the second mode occurring concurrently with the first mode.

A wireline cement evaluation tool 208 is so that the wireline cement evaluation tool is calibrated by baseline values for a free pipe with water or air behind the casing 306. Then deviations from the baseline values may be used to interpret cementitious material in the sheathing 304 behind the casing 306.

An acoustic pulse of suitable frequency may be transmitted from within the borehole 308. A signal attenuation from fluid in the casing 306, the casing itself, and the material in the annulus (such as the cementitious or other material) next to the casing 306 may be measured on a reflected wave. Annulus may be in reference to an area between a cement layer 304 and a casing 306. Borehole fluid and the material properties of a casing and surrounding materials may be accounted for by such a feature. However, in addition, to enable evaluation of the fluid or material behind the casing itself, use of a combination of AL and SHA waves are used in a wireline cement evaluation tool 208.

A wireline cement evaluation tool or a logging tool 208 may be designed with fixed or varying transmitter frequencies (from one or more wave generators capable of generating different frequencies). Such wave generators may be part of a singular transmitter having features therein to operate in different frequencies. As such, a single wave generator able to provide two distinct signals. These frequencies can be sonic or ultrasonic. A wireline cement evaluation tool 208 may therefore include one or more wave generators (such as transducers or transmitters) that can emit acoustic wave.

A wireline cement evaluation tool 208 may include one or more receivers placed at a fixed distance from such wave generators. One or more such receivers are able to detect or to receive indications associated with the SHA waves and the AL waves. For example, one or more such receivers can detect or receive a reflected wave. At least one processor or such a receiver can record an amplitude of a reflected wave, as part of an indication received from a reflected wave. Waves that are applied or received may include compressional, shear or flexural waves. However, use of a combination of the SHA waves and the AL waves addresses issues where a nature of a borehole fluid (such as oil or water-based), type and density of cementitious material, and density of a wellbore fluid may other be a challenge in identifying and differentiating cementitious material behind a casing. Such a challenge increases as a density of a wellbore fluid increases.

Other issues addressed by a system herein is that a downhole tool herein may be used with different casing diameters. A larger casing diameter may be more challenging to enable detection of cementitious material behind a casing due to the increased distance of travel of the acoustic wave. Further, a casing's properties, such as material composition and thickness also pose a challenge to enable detection of cementitious material behind a casing, but which is resolved by a system as disclosed herein.

Further, casing material composition as well as casing thickness are determined for calibration of baseline values used in a system having a downhole tool disclosed herein. Cement evaluation through tool acquisition relies on a tool's ability to generate an acoustic wave which causes vibrations or resonations in a casing. An ability of a casing to vibrate or resonate can be a function of a quantity and a quality of a sheathing material behind a casing. High vibrations or resonance may be expected when a casing is free, such as having liquid or gas in an annular space.

As an amount and quality of solid material increases behind a casing, it may be expected to vibrate or resonate less. An ability to evaluate a condition of a cementitious material of a sheathing behind a casing may be dependent on such vibrations or resonance of the casing. As such, a casing's properties, including its material composition and thickness are of particular interest when setting AL and SHA waves required for identification or differentiation of fluids and solids behind a casing.

Wellbores may be completed with a thin casing that is 0.2 to 0.5 inch in thickness. Such wellbores may be made of carbon steel materials. In such designs, cement evaluation can be performed to account for some of the above-referenced challenges (including type of borehole fluids, casing diameter, cement types and density, and other aspects). Although casings made of carbon steel materials are used, these types of casing may not always provide adequate downhole protection in some environments and conditions.

In an example, with respect to pressure, some environments may operate at higher pressures. Such higher pressures can be expected at any stage of a life cycle of a well (including during stimulation, workover, injection, production, and other aspects of the well). In another example, corrosion, such as on an internal and/or on an external feature of a casing may be considered. External casing corrosion may be associated with lack of or poor cement condition combined with corrosive downhole fluids accumulating or flowing around an external surface of the casing.

In another example, downhole stresses cause resulting forces to an outer surface of a casing. A magnitude of these forces can change over a life cycle of a well by increasing or decreasing due to downhole natural stress activities. Similar changes may be induced by formation movements as a result of an increased removal of downhole fluids during production of a well.

Due to such challenges, a design used in wellbore applications may include thicker casings. Thicker casings may range from 0.5 inch to over 1 inch in thickness. An increased thickness makes it possible to sustain higher pressures and higher stresses. This may further delay the corrosion process. However, increased casing thickness is not always enough, particularly in sour and corrosive environments, in which case alloys-based casings are designed and deployed for such hostile downhole environments. These alloys may be a mixture of different elements depending on an expected downhole conditions in which the casing is to be deployed. One such element used at varying concentrations to create an alloy casing is chromium. As such, a system used herein is able to be used with high chromium-based casings.

Chromium is added to the steel at different quantities to improve a response to heat treatment during a manufacturing process of the casing and to improve the strength and corrosion resistance once deployed in the oil/gas well. Chromium concentrations may vary from 3 to 10%. However higher chromium content may also be available and used. Examples of high chromium content include from 13%, 20%, 25%, till 28% chromium by weight % of a material used for a casing. As chromium concentration increases to provide the desired downhole protection, a negative effect is observed on the ability of cement evaluation tools to properly transmit the acoustic wave needed to vibrate/resonate the casing.

Due to the process of adding the chromium, the casing becomes anisotropic, and this results in a much more dispersive waveform response and other factors must be considered. As such it is necessary to use a variation of wave modes to successfully determine the fluid or material on the back side of the casing. Whereas the response of many technologies discussed throughout herein may be also influenced by fluid inside a casing, the present system removes ambiguity as well in its process.

Technologies in the industry may be limited at a maximum chromium content of around 13%. Once a chromium concentration exceeds such an upper limit of 13%, cement evaluation responses will not change significantly between a free pipe and a bonded pipe. This makes interpretation of a cement quality behind the casing difficult when using singular wave-type devices.

In at least one embodiment, a method 400 includes steps 402, 404 for providing, using one or more wave generators, at least asymmetric lamb (AL) waves through the casing having an anisotropic property in a first mode of the method and at least shear horizontal acoustic (SHA) waves through the casing in a second mode of the method, the first mode and the second mode to operate concurrently. A step 406 of the method 400 enables a receiver to receive indications associated with an applied AL and SHA waves. A step 408 of the method 400 enables determinations of whether there are indicators associated with the AL and the SHA waves received in a receiver. A step 410 of the method 400 enables determination, using at least one processor, of a quality of the sheathing behind the casing based in part on the indications associated with the SHA waves and the AL waves.

Figure 5:
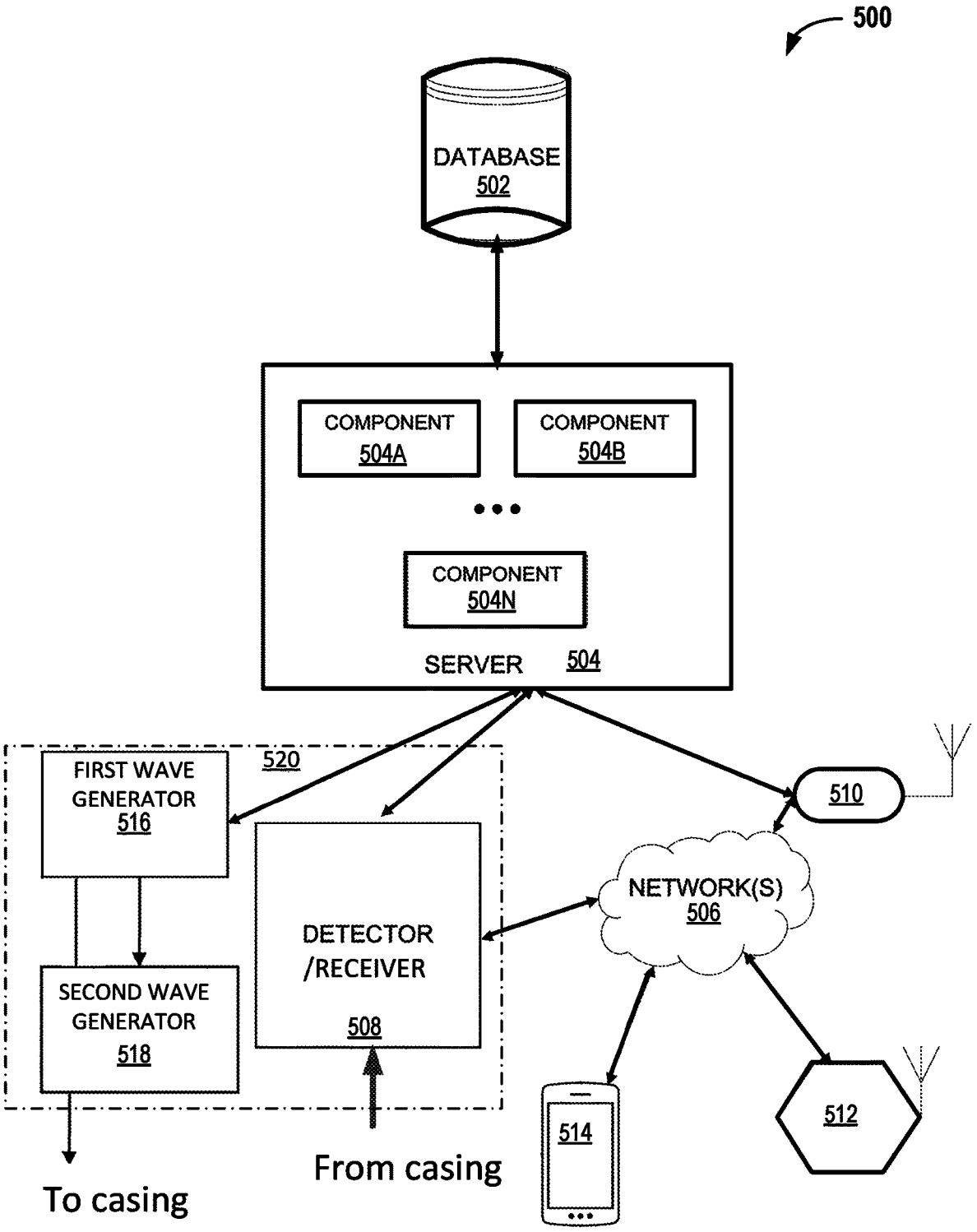
FIG. 5 illustrates computer and network aspects for a system of a downhole tool that can include a wireline cement evaluation tool within the system for identification or differentiation of annular solids and fluids associated with an anisotropic casing using a combination of shear and flexural acoustic waves, in at least one embodiment herein, according to at least one embodiment.

In at least one embodiment, computer and network aspects 500 for a downhole system as illustrated in FIG. 5, may be used as described herein. In at least one embodiment, these computer and network aspects 500 may include a distributed system. In at least one embodiment, a distributed system 500 may include one or more computing devices 512, 514. In at least one embodiment, one or more computing devices 512, 514 may be adapted to execute and function with a client application, such as with browsers or a standalone application, and are adapted to execute and function over one or more network(s) 506.

In at least one embodiment, a server 504, having components 504A-N may be communicatively coupled with computing devices 512, 514 via network 506 and via a receiver device 508, if provided. In at least one embodiment, components 512, 514 include processors, memory and random-access memory (RAM). In at least one embodiment, server 504 may be adapted to operate services or applications to manage functions and sessions associated with database access 502 and associated with computing devices 512, 514. In at least one embodiment, server 504 may be associated with a receiver or detector device 508 of a downhole tool 520.

In at least one embodiment, server 504 may be at a wellsite location, but may also be at a distinct location from a wellsite location. In at least one embodiment, such a server 504 may support a downhole tool or wireline cement evaluation tool 520 within a downhole tool. A first and a second wave generator 516, 518 or a single wave generator may provide AL and SHA waves for a casing of a borehole. The receiver or detector device 508 of a downhole tool 520 receiving reflected waves from the casing.

In at least one embodiment, a system for evaluation of a sheathing behind a casing of a wellbore includes a wireline cement evaluation tool that is adapted to transmit, either through wires or wireless, information received therein, from a detector or a receiver back to the surface. In at least one embodiment, such information may be received in a receiver device and transmitted from there. In at least one embodiment, a server 504 may function as a detector or receiver device but may also perform other functions. In at least one embodiment, one or more component 504A-N may be adapted to function as a detector or receiver device within a server 504. In at least one embodiment, one or more components 504A-N may include one or more processors and one or more memory devices adapted to function as a detector or receiver device, while other processors and memory devices in server 504 may perform other functions.

In at least one embodiment, a server 504 may also provide services or applications that are software-based in a virtual or a physical environment. In at least one embodiment, when server 504 is a virtual environment, then components 504A-N are software components that may be implemented on a cloud. In at least one embodiment, this feature allows remote operation of a system for evaluation of a sheathing behind a casing of a wellbore using a wireline cement evaluation tool, as discussed at least in reference to FIGS. 1-4. In at least one embodiment, this feature also allows for remote access to information received and communicated between any of aforementioned devices. In at least one embodiment, one or more components 504A-N of a server 504 may be implemented in hardware or firmware, other than a software implementation described throughout herein. In at least one embodiment, combinations thereof may also be used.

In at least one embodiment, one computing device 510-514 may be a smart monitor or a display having at least a microcontroller and memory having instructions to enable display of information monitored by a detector or receiver device. In at least one embodiment, one computing device 510-512 may be a transmitter device to transmit directly to a receiver device or to transmit via a network 506 to a receiver device 508 and to a server 504, as well as to other computing devices 512, 514.

In at least one embodiment, other computing devices 512, 514 may include portable handheld devices that are not limited to smartphones, cellular telephones, tablet computers, personal digital assistants (PDAs), and wearable devices (head mounted displays, watches, etc.). In at least one embodiment, other computing devices 512, 514 may operate one or more operating systems including Microsoft Windows Mobile®, Windows® (of any generation), and/or a variety of mobile operating systems such as iOS®, Windows Phone®, Android®, BlackBerry®, Palm OS®, and/or variations thereof.

In at least one embodiment, other computing devices 512, 514 may support applications designed as internet-related applications, electronic mail (email), short or multimedia message service (SMS or MMS) applications, and may use other communication protocols. In at least one embodiment, other computing devices 512, 514 may also include general purpose personal computers and/or laptop computers running such operating systems as Microsoft Windows®, Apple Macintosh®, and/or Linux®. In at least one embodiment, other computing devices 512, 514 may be workstations running UNIX® or UNIX-like operating systems or other GNU/Linux operating systems, such as Google Chrome OS®. In at least one embodiment, thin-client devices, including gaming systems (Microsoft Xbox®) may be used as other computing device 512, 514.

In at least one embodiment, network(s) 506 may be any type of network that can support data communications using various protocols, including TCP/IP (transmission control protocol/Internet protocol), SNA (systems network architecture), IPX (Internet packet exchange), AppleTalk®, and/or variations thereof. In at least one embodiment, network(s) 506 may be a networks that is based on Ethernet, Token-Ring, a wide-area network, Internet, a virtual network, a virtual private network (VPN), a local area network (LAN), an intranet, an extranet, a public switched telephone network (PSTN), an infra-red network, a wireless network (such as that operating with guidelines from an institution like the Institute of Electrical and Electronics (IEEE) 802.11 suite of protocols, Bluetooth®, and/or any other wireless protocol), and/or any combination of these and/or other networks.

In at least one embodiment, a server 504 runs a suitable operating system, including any of operating systems described throughout herein. In at least one embodiment, server 504 may also run some server applications, including HTTP (hypertext transport protocol) servers, FTP (file transfer protocol) servers, CGI (common gateway interface) servers, JAVA® servers, database servers, and/or variations thereof. In at least one embodiment, a database 502 is supported by database server feature of a server 504 provided with front-end capabilities. In at least one embodiment, such database server features include those available from Oracle®, Microsoft®, Sybase®, IBM® (International Business Machines), and/or variations thereof.

In at least one embodiment, a server 504 is able to provide feeds and/or real-time updates for media feeds. In at least one embodiment, a server 504 is part of multiple server boxes spread over an area, but functioning for a presently described process for fast in-field chromatography. In at least one embodiment, server 504 includes applications to measure network performance by network monitoring and traffic management. In at least one embodiment, a provided database 502 enables information storage from a wellsite, including user interactions, usage patterns information, adaptation rules information, and other information.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

Terms such as a, an, the, and similar referents, in context of describing disclosed embodiments (especially in context of following claims), are understood to cover both singular and plural, unless otherwise indicated herein or clearly contradicted by context, and not as a definition of a term. Including, having, including, and containing are understood to be open-ended terms (meaning a phrase such as, including, but not limited to) unless otherwise noted. Connected, when unmodified and referring to physical connections, may be understood as partly or wholly contained within, attached to, or joined together, even if there is something intervening.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two, but can be more when so indicated either explicitly or by context. Further, unless stated otherwise or otherwise clear from context, phrases such as based on means based at least in part on and not based solely on.

Operations of methods 600 and 700 or sub-steps described herein can be performed in any suitable order unless otherwise indicated herein or otherwise clearly contradicted by context. In at least one embodiment, a method includes processes such as those processes described herein (or variations and/or combinations thereof) that may be performed under control of one or more computer systems configured with executable instructions and that may be implemented as code (e.g., executable instructions, one or more computer programs or one or more applications) executing collectively or exclusively on one or more processors, by hardware or combinations thereof.

In at least one embodiment, such code may be stored on a computer-readable storage medium. In at least one embodiment, such code may be a computer program having instructions executable by one or more processors. In at least one embodiment, a computer-readable storage medium is a non-transitory computer-readable storage medium that excludes transitory signals (such as a propagating transient electric or electromagnetic transmission) but includes non-transitory data storage circuitry (such as buffers, cache, and queues) within transceivers of transitory signals. In at least one embodiment, code (such as executable code or source code) is stored on a set of one or more non-transitory computer-readable storage media having stored thereon executable instructions (or other memory to store executable instructions) that, when executed (such as a result of being executed) by one or more processors of a computer system, cause computer system to perform operations described herein.

In at least one embodiment, a set of non-transitory computer-readable storage media includes multiple non-transitory computer-readable storage media and one or more of individual non-transitory storage media of multiple non-transitory computer-readable storage media lack all of code while multiple non-transitory computer-readable storage media collectively store all of code. In at least one embodiment, executable instructions are executed such that different instructions are executed by different processors—in at least one embodiment, a non-transitory computer-readable storage medium store instructions and a main central processing unit (CPU) executes some of instructions while other processing units execute other instructions. In at least one embodiment, different components of a computer system have separate processors and different processors execute different subsets of instructions.

In at least one embodiment, computer systems are configured to implement one or more services that singly or collectively perform operations of processes described herein and such computer systems are configured with applicable hardware and/or software that enable performance of operations. In at least one embodiment, a computer system that implements at least one embodiment of present disclosure is a single device or is a distributed computer system having multiple devices that operate differently such that distributed computer system performs operations described herein and such that a single device does not perform all operations.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages, and can be used in a variety of applications. Various embodiments may be combined or modified based in part on the present disclosure, which is readily understood to support such combination and modifications to achieve the benefits described above.

What is claimed is:

1. A system for evaluation of a sheathing behind a casing of a wellbore, the system comprising:

one or more wave generators, wherein each generator of the one or more generators is to provide asymmetric lamb (AL) waves through a casing having an anisotropic property in a first mode of the system and is to provide at least shear horizontal acoustic (SHA) waves, from the AL waves, through the casing in a second mode of the system, the first mode and the second mode to operate concurrently;

a receiver to receive indications associated with the SHA waves and the AL waves; and at least one processor adapted to determine a quality of the sheathing behind the casing based in part on the indications associated with the SHA waves and the AL waves, wherein the indications comprise baseline values associated with the anisotropic property of the casing and comprise deviations from the baseline values, the deviations associated with the quality of the sheathing.

2. The system of claim 1, wherein the at least one processor executes instructions that cause at least:

an evaluation of a cement thickness, as part of the determination of the quality of the sheathing, based in part on a vibration or resonance information from the SHA waves, the AL waves, and based in part on the indications associated with the SHA waves and the AL waves.

3. The system of claim 1, wherein the receiver is enabled to receive a reflected wave associated with particles released by at least a material of the sheathing, the reflected wave representing the indications associated with the SHA waves and the AL waves by an interaction of one or more of the SHA waves or the AL waves with the particles.

4. The system of claim 1, wherein the indications associated with the SHA waves and the AL waves are associated with different components therein to indicate presence of fluids and solids behind the casing.

5. The system of claim 1, wherein the quality of the sheathing comprises a bonding strength from the indications associated with the SHA waves and the AL waves, the bonding strength indicative of a strength of a chemical bond or a mechanical or frictional bond.

6. The system of claim 1, wherein the quality of the sheathing comprises a shear modulus and a compressional modulus determined from the indications associated with the SHA waves and the AL waves, the shear modulus and the compressional modulus associated with a material of the sheathing and that is bonded with the casing.

7. The system of claim 1, wherein the first mode comprises coupled compressional waves and shear waves as part of the AL waves, the AL waves enabling a particle displacement that is in a direction that is normal to a surface of the casing and comprising wave propagation that is perpendicular to the direction of the particle displacement.

8. The system of claim 1, wherein the first mode enables a particle displacement that is in a first direction that is normal to a surface of the casing, the particle displacement caused to rotate through a 90° angle from the first direction based in part on the first mode being concurrently active with the second mode, the 90° angle to cause the particle displacement to be in a second direction that is parallel to the surface of the casing.

9. The system of claim 1, wherein the first mode causes a first direction for particles from the sheathing and the second mode cause a transition of the first direction to a second direction by at least the second mode occurring concurrently with the first mode.

10. The system of claim 1, comprising a wireline cement evaluation tool, wherein the wireline cement evaluation tool is calibrated by the baseline values for a free pipe with water or air behind the casing and for the anisotropic property of the casing, and wherein the deviations from the baseline values are used to interpret cement in the sheathing behind the casing.

11. A method for evaluation of a sheathing behind a casing of a wellbore, the method comprising:

providing, using each generator of one or more wave generators, asymmetric lamb (AL) waves through the casing having an anisotropic property in a first mode of the method and at least shear horizontal acoustic (SHA) waves, that is from the AL waves, through the casing in a second mode of the method, the first mode and the second mode to operate concurrently;

receiving, using a receiver, indications associated with the SHA waves and the AL waves; and determining, using at least one processor, a quality of the sheathing behind the casing based in part on the indications associated with the SHA waves and the AL waves, wherein the indications comprise baseline values associated with the anisotropic property of the casing and comprise deviations from the baseline values, the deviations associated with the quality of the sheathing.

12. The method of claim 11, further comprising:

evaluating, using the at least one processor, a cement thickness, as part of the determination of the quality of the sheathing, based in part on a vibration or resonance information from the SHA waves, the AL waves, and based in part on the indications associated with the SHA waves and the AL waves.

13. The method of claim 11, wherein the receiver is a reflected wave receiver and wherein the method further comprises:

receiving, by a reflected wave receiver, a reflected wave associated with particles released by at least a material of the sheathing, the reflected wave representing the indications associated with the SHA waves and the AL waves by an interaction of one or more of the SHA waves or the AL waves with the particles.

14. The method of claim 11, wherein the indications associated with the SHA waves and the AL waves are associated with different components therein to indicate presence of fluids and solids behind the casing.

15. The method of claim 11, wherein the quality of the sheathing comprises a bonding strength from the indications associated with the SHA waves and the AL waves, the bonding strength indicative of a strength of a chemical bond or a mechanical or frictional bond.

16. The method of claim 11, wherein the quality of the sheathing comprises a shear modulus and a compressional modulus determined from the indications associated with the SHA waves and the AL waves, the shear modulus and the compressional modulus associated with a material of the sheathing and that is bonded with the casing.

17. The method of claim 11, wherein the first mode comprises coupled compressional waves and shear waves as part of the AL waves, the AL waves enabling a particle displacement that is in a direction that is normal to a surface of the casing and comprising wave propagation that is perpendicular to the direction of the particle displacement.

18. The method of claim 11, further comprises:

enabling, in the first mode, a particle displacement that is in a first direction that is normal to a surface of the casing;

causing, by the second mode that is concurrent with the first mode, the particle displacement to rotate through a 90° angle from the first direction, the 90° angle to cause the particle displacement to be in a second direction that is parallel to the surface of the casing.

19. The method of claim 11, further comprising:

causing, by the first mode, a first direction for particles associated with the sheathing; and causing, by the second mode, a transition of the first direction to a second direction by at least the second mode occurring concurrently with the first mode.

20. The method of claim 11, further comprising:

calibrating a wireline cement evaluation tool to the baseline values for a free pipe comprising water or air behind the casing and to the anisotropic property; and using the deviations from the baseline values to interpret cement as part of the sheathing behind the casing.

* * * * *